US009226625B1

(12) United States Patent
Jefferson

(10) Patent No.: US 9,226,625 B1
(45) Date of Patent: Jan. 5, 2016

(54) WASHING SYSTEM

(71) Applicant: Renay Jefferson, Charlotte, NC (US)

(72) Inventor: Renay Jefferson, Charlotte, NC (US)

( * ) Notice: Subject to any disclaimer, the term of this patent is extended or adjusted under 35 U.S.C. 154(b) by 425 days.

(21) Appl. No.: 13/719,825

(22) Filed: Dec. 19, 2012

(51) Int. Cl.

| | |
|---|---|
| ***A47K 7/02*** | (2006.01) |
| ***A47K 7/03*** | (2006.01) |
| ***A47K 5/04*** | (2006.01) |
| ***A46B 5/04*** | (2006.01) |
| ***A46B 5/00*** | (2006.01) |

(52) U.S. Cl.
CPC ... *A47K 7/02* (2013.01); *A46B 5/00* (2013.01); *A46B 5/04* (2013.01); *A47K 7/03* (2013.01)

(58) Field of Classification Search
CPC ..... A47K 7/02
USPC ..... 401/201, 196, 200; 15/227, 159.1, 118; 510/130
See application file for complete search history.

(56) References Cited

U.S. PATENT DOCUMENTS

| | | | | |
|---|---|---|---|---|
| 4,457,640 | A | 7/1984 | Anderson | |
| 5,462,378 | A | 10/1995 | Webb | |
| D413,477 | S | 9/1999 | Chaney | |
| 6,065,177 | A * | 5/2000 | Chien | 15/227 |
| 6,264,391 | B1 | 7/2001 | Kroha | |
| 6,510,577 | B1 | 1/2003 | Borcherds et al. | |
| 7,014,381 | B1 * | 3/2006 | Graham | 401/201 |
| D561,389 | S | 2/2008 | Hunter | |
| 7,517,841 | B2 * | 4/2009 | Coleman et al. | 510/130 |
| 2005/0016872 | A1 | 1/2005 | Johnson | |

OTHER PUBLICATIONS www.amazon.com: Earthline Sisal Soap Sack Medium 491 Natural Bodycare Essentials: Beauty; internet as of Dec. 18, 2012.
www.leafa.com; Leafa—the bath mitt with a soap pocket; internet as of Dec. 18, 2012.

* cited by examiner

*Primary Examiner* — Paul R Durand
*Assistant Examiner* — Thomas M Abebe

(57) ABSTRACT

A porous bag with a bag aperture connected to a bag cavity with a draw string located in a channel surrounding the bag aperture for cinching the bag closed. The system includes a first sponge that is arc shaped with a first sponge concave surface and a second sponge that is arc shaped with a second sponge concave surface. A first sponge bottom side is pivotally located on a second sponge bottom side. A bag bottom side is pivotally located on the first sponge bottom side and the second sponge bottom side. The porous bag is located between the first sponge concave surface and the second sponge concave surface.

2 Claims, 3 Drawing Sheets

WASHING SYSTEM

BACKGROUND OF THE INVENTION

Often when using a bar of soap for numerous washings, the bar becomes too small to use, leaving a portion of the bar of soap to be discarded (wasted). The present invention features a washing system that uses a bar of soap inside a porous bag encased within two sponges. The present invention uses the entire bar of soap.

SUMMARY

The present invention features a porous bag having a bag aperture connected to a bag cavity. A draw string is located in a channel surrounding the bag aperture for cinching the bag closed. In some embodiments, the system comprises a first sponge. In some embodiments, the first sponge is arc-shaped with a first sponge concave surface and a first sponge convex surface. In some embodiments, the system comprises a second sponge. In some embodiments, the second sponge is arc-shaped with a second sponge concave surface and a second sponge convex surface.

In some embodiments, first sponge bottom side is pivotally located on a second sponge bottom side. In some embodiments, a bag bottom side is pivotally located on the first sponge bottom side and the second sponge bottom side. In some embodiments, the porous bag is located between the first sponge concave surface and the second sponge concave surface.

Any feature or combination of features described herein are include within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
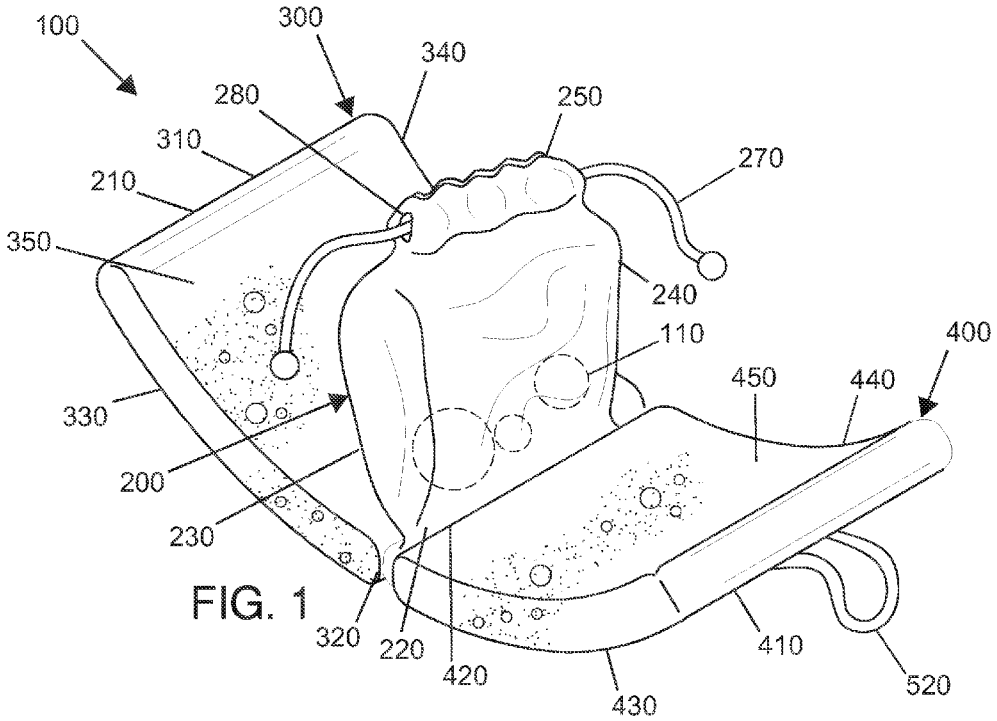
FIG. 1 is a perspective view of the present invention in an open position.
Figure 2:
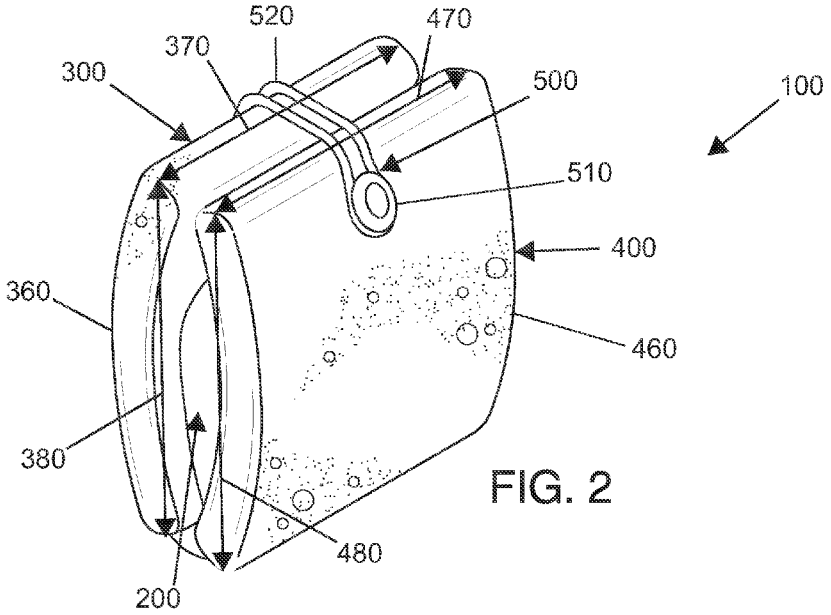
FIG. 2 is a perspective view of the present invention in a closed position.
Figure 3:
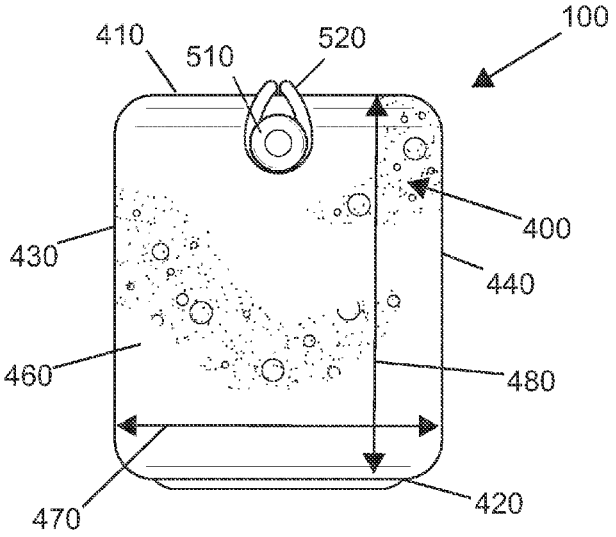
FIG. 3 is a front view of the second sponge of the present invention.
Figure 4:
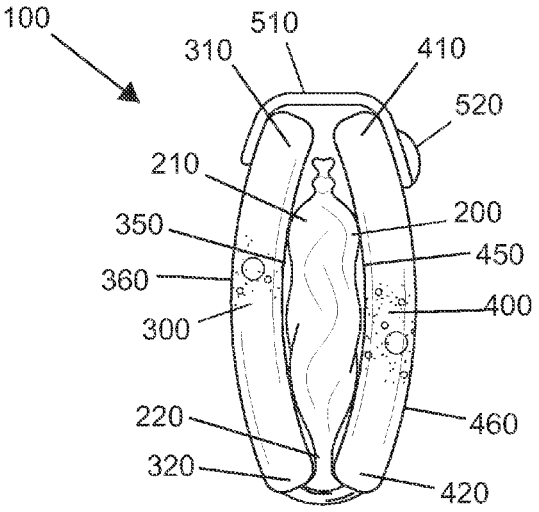
FIG. 4 is a side view of the present invention.
Figure 5:
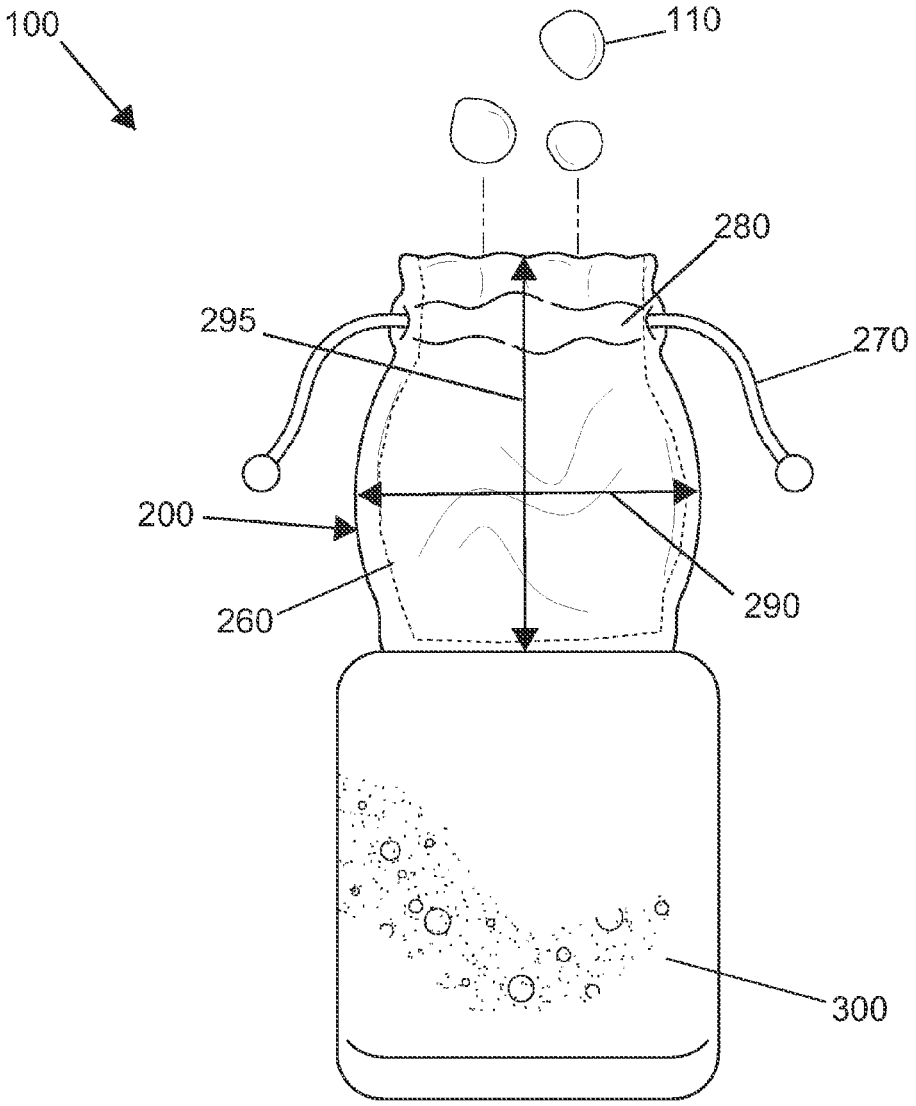
FIG. 5 is an inside view of the present invention featuring the first sponge and the porous bag.

Following is a list of elements corresponding to a particular element referred to herein:

100 Washing system
110 Bar of soap
200 Porous bag
210 Bag top side
220 Bag bottom side
230 Bag first side
240 Bag second side
250 Bag aperture
260 Bag cavity
270 Draw string
280 Channel
290 Porous bag width
295 Porous bag length
300 First sponge
310 First sponge top side
320 First sponge bottom side
330 First sponge first side
340 First sponge second side
350 First sponge concave surface
360 First sponge convex surface
370 First sponge width
380 First sponge length
400 Second sponge
410 Second sponge top side
420 Second sponge bottom side
430 Second sponge first side
440 Second sponge second side
450 Second sponge concave surface
460 Second sponge convex surface
470 Second sponge with
480 Second sponge length
500 Attaching means
510 First attaching means component
520 Second attaching means component Referring now to FIG. 1-5, the present invention features a washing system (100). In some embodiments, the system (100) comprises a bar of soap (110). In some embodiments, the bar of soap (110) is a typical bar of soap (110) commonly used for taking a bath. In some embodiments the bar of soap (110) is a small sliver remaining from a typical bar of soap (110) that has been used for taking a bath.

In some embodiments, the system (100) comprises a porous bag (200) having a bag top side (210), a bag bottom side (220), a bag first side (230), and a bag second side (240). In some embodiments, the bag top side (210) comprises a bag aperture (250) disposed thereon fluidly connected to a bag cavity (260) disposed in the porous bag (200). In some embodiments, a draw string (270) is disposed in a channel (280) surrounding the bag aperture (250) for cinching the bag aperture (250) closed. In some embodiments, the bar of soap (110) is disposed in the bag cavity (260). In some embodiments, more than one bar of soap (110) is disposed in the bag cavity (260).

In some embodiments, the porous bag (200) is mesh. In some embodiments, the porous bag (200) is constructed from cotton.

In some embodiments, the system (100) comprises a first sponge (300) having a first sponge top side (310), a first sponge bottom side (320), a first sponge first side (330), and a first sponge second side (340). In some embodiments, the first sponge (300) is arc-shaped from the first sponge top side (310) to the first sponge bottom side (320). In some embodiments, the first sponge (300) comprises a first sponge concave surface (350) and a first sponge convex surface (360). In some embodiments, the first sponge width (370) from the first sponge first side (330) to the first sponge second side (340) is larger than a porous bag width (290) from the bag first side (230) to the bag second side (240). In some embodiments, a first sponge length (380) from the first sponge to side (310) to the first sponge bottom side (320) is larger than a porous bag length (295) from the bag to side (210) to the bag bottom side (220).

In some embodiments, the system (100) comprises a second sponge (400) having a second sponge top side (410), a second sponge bottom side (420), a second sponge first side (430), and a second sponge second side (440). In some embodiments, the second sponge (400) is arc-shaped from the second sponge top side (410) to the second sponge bottom side (420). In some embodiments, the second sponge (400) comprises a second sponge concave surface (450) and a second sponge convex surface (460). In some embodiments, the second sponge (400) comprises a second sponge width (470) equal to the first sponge width (370). In some embodiments, the second sponge (400) comprises a second sponge length (480) equal to the first sponge length (380).

In some embodiments, the first sponge bottom side (320) is pivotally disposed on the second sponge bottom side (420). In some embodiments, the bag bottom side (220) is pivotally disposed on the first sponge bottom side (320) and the second sponge bottom side (420). In some embodiments, the porous bag (200) is disposed between the first sponge concave surface (350) and the second sponge concave surface (450). In some embodiments, the first sponge (300) and the second sponge (400) completely overlap and sandwich the porous bag (200). In some embodiments, an attaching means (500) comprises a first attaching means component (510) disposed on the first sponge top side (310) and a mated second attaching means component (520) disposed on the opposing second sponge top side (410) for fastening the first sponge top side (310) to the first sponge bottom side (320).

In some embodiments, the attaching means (500) comprises a button and a loop. In some embodiments, the attaching means (500) comprises a mated pair of snaps. In some embodiments, the attaching means (500) comprises a hook and loop system.

As used herein, the term "about" refers to plus or minus 10% of the referenced number. For example, an embodiment wherein the porous bag is about 10 inches in length includes a porous bag that is between 9 and 11 inches in length.

The disclosures of the following U.S. Patents are incorporated in their entirety by reference herein: U.S. Pat. No. 4,457,640; U.S. Pat. No. 5,462,378; U.S. Pat. No. 6,264,391; U.S. Pat. No. 6,510,577; U.S. Patent Pub. No. 2005/0016872; U.S. Pat. No. D 413,477; and U.S. Pat. No. D 561,389.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A washing system (100), wherein said system (100) comprises:

(a) a bar of soap (110);

(b) a porous bag (200) having a bag top side (210), a bag bottom side (220), a bag first side (230), and a bag second side (240), wherein the bag top side (210) comprises a bag aperture (250) disposed thereon fluidly connected to a bag cavity (260) disposed in the porous bag (200), wherein a draw string (270) is disposed in a channel (280) surrounding the bag aperture (250) for cinching the bag aperture (250) closed, wherein the bar of soap (110) is disposed in the bag cavity (260);

(c) a first sponge (300) having a first sponge top side (310), a first sponge bottom side (320), a first sponge first side (330), and a first sponge second side (340), wherein the first sponge (300) is arc-shaped from the first sponge top side (310) to the first sponge bottom side (320), wherein the first sponge (300) comprises a first sponge concave surface (350) and a first sponge convex surface (360), wherein a first sponge width (370) from the first sponge first side (330) to the first sponge second side (340) is larger than a porous bag width (290) from the bag first side (230) to the bag second side (240), wherein a first sponge length (380) from the first sponge top side (310) to the first sponge bottom side (320) is larger than a porous bag length (295) from the bag top side (210) to the bag bottom side (220); and (d) a second sponge (400) having a second sponge top side (410), a second sponge bottom side (420), a second sponge first side (430), and a second sponge second side (440), wherein the second sponge (400) is arc-shaped from the second sponge top side (410) to the second sponge bottom side (420), wherein the second sponge (400) comprises a second sponge concave surface (450) and a second sponge convex surface (460), wherein the second sponge (400) comprises a second sponge width (470) equal to the first sponge width (370), wherein the second sponge (400) comprises a second sponge length (480) equal to the first sponge length (380);

wherein the first sponge bottom side (320) is pivotally connected to the second sponge bottom side (420), wherein the bag bottom side (220) is pivotally connected to the first sponge bottom side (320) and the second sponge bottom side (420), wherein the porous bag (200) is disposed between the first sponge concave surface (350) and the second sponge concave surface (450), wherein the first sponge (300) and the second sponge (400) completely overlap and sandwich the porous bag (200), wherein an attaching means (500) comprises a first attaching means component (510) disposed on the first sponge top side (310) and a mated second attaching means component (520) disposed on the opposing second sponge top side (410) for fastening the first sponge top side (310) to the first sponge bottom side (320).

2. A washing system (100), wherein said system (100) consists of:

(a) a bar of soap (110);

(b) a porous bag (200) having a bag top side (210), a bag bottom side (220), a bag first side (230), and a bag second side (240), wherein the bag top side (210) consists of a bag aperture (250) disposed thereon fluidly connected to a bag cavity (260) disposed in the porous bag (200), wherein a draw string (270) is disposed in a channel (280) surrounding the bag aperture (250) for cinching the bag aperture (250) closed, wherein the bar of soap (110) is disposed in the bag cavity (260);

(c) a first sponge (300) having a first sponge top side (310), a first sponge bottom side (320), a first sponge first side (330), and a first sponge second side (340), wherein the first sponge (300) is arc-shaped from the first sponge top side (310) to the first sponge bottom side (320), wherein the first sponge (300) consists of a first sponge concave surface (350) and a first sponge convex surface (360), wherein a first sponge width (370) from the first sponge first side (330) to the first sponge second side (340) is larger than a porous bag width (290) from the bag first side (230) to the bag second side (240), wherein a first sponge length (380) from the first sponge top side (310) to the first sponge bottom side (320) is larger than a porous bag length (295) from the bag top side (210) to the bag bottom side (220); and (d) a second sponge (400) having a second sponge top side (410), a second sponge bottom side (420), a second sponge first side (430), and a second sponge second side (440), wherein the second sponge (400) is arc-shaped from the second sponge top side (410) to the second sponge bottom side (420), wherein the second sponge (400) consists of a second sponge concave surface (450) and a second sponge convex surface (460), wherein the second sponge (400) consists of a second sponge width (470) equal to the first sponge width (370), wherein the second sponge (400) consists of a second sponge length (480) equal to the first sponge length (380);

wherein the first sponge bottom side (320) is pivotally connected to the second sponge bottom side (420), wherein the bag bottom side (220) is pivotally connected to the first sponge bottom side (320) and the second sponge bottom side (420), wherein the porous bag (200) is disposed between the first sponge concave surface (350) and the second sponge concave surface (450), wherein the first sponge (300) and the second sponge (400) completely overlap and sandwich the porous bag (200), wherein an attaching means (500) consists of a first attaching means component (510) disposed on the first sponge top side (310) and a mated second attaching means component (520) disposed on the opposing second sponge top side (410) for fastening the first sponge top side (310) to the first sponge bottom side (320).

* * * * *